US006149845A

United States Patent [19]

Ren

[11] Patent Number: 6,149,845

[45] Date of Patent: Nov. 21, 2000

[54] METHOD OF MANUFACTURING PAPER COFFIN FOR USE IN CREMATION

[76] Inventor: Shieh Chwan Ren, Yan-Si-Wou 35-2, Houkou, Hsinchu, Taiwan

[21] Appl. No.: 09/280,905

[22] Filed: Mar. 29, 1999

[51] Int. Cl.[7] ..... B29C 51/02

[52] U.S. Cl. ..... 264/87; 162/220; 162/224; 264/132; 264/293; 264/320; 264/914

[58] Field of Search ..... 264/87, 132, 293, 264/320, 914; 162/220, 224

[56] References Cited

U.S. PATENT DOCUMENTS 4,162,935 7/1979 Kollmann et al. ..... 162/220

*Primary Examiner*—Leo B. Tentoni

*Attorney, Agent, or Firm*—W. Wayne Liauh

[57] ABSTRACT

A method of manufacturing paper coffin for use in cremation including the steps of forming a box and a cover for a coffin from prepared pulp by vacuum molding, drying the molded box and cover, compressing walls of the box and of the cover in a die casting machine to consolidate them and give them enhanced structural strength, and painting the box and the cover so that the coffin has beautified outer surfaces. Dies for compressing the walls of the box and the cover may be provided with patterns so as to form raised or depressed patterns on outer wall surfaces of the coffin.

3 Claims, 2 Drawing Sheets

METHOD OF MANUFACTURING PAPER COFFIN FOR USE IN CREMATION

FIELD OF THE INVENTION

The present invention relates to a method of manufacturing paper coffin for use in cremation. The coffin is made of papermaking pulp prepared from waste and recycled paper and it walls are compressed to create enhanced structural strength and beautified appearance.

BACKGROUND OF THE INVENTION

With quickly increased population of the world and the fact that there is only limited land available for use by human being, cremation has become an inevitable trend in many countries. A coffin for use in the cremation must be made of combustible material, such as wood and paper. The use of large quantity of wood material would have adverse influence on the protection of environment and natural resource. Therefore, it seems improper to make coffins with wood. Moreover, since the coffin is burnt to ashes along with the corpse carried by it, it would be more practical and economical to use paper coffin. Paper coffins used in early stage are made by folding corrugated paperboards into a desired shape. Such corrugated paperboard coffin has only limited structural strength and is therefore not reliable for use. Thereafter, there is other paper coffin developed by assembling paper panels together. To strengthen the paper panels, supporting walls are provided between inner and outer layers of each paper panel. The supporting walls may include perpendicularly intersected studs or honeycomb structure that would increase the cost of manufacturing the paper coffin.

SUMMARY OF THE INVENTION

It is therefore a primary object of the present invention to provide a method of manufacturing paper coffin for use in cremation at reduced cost. The method includes steps of forming a box and a cover of the coffin from prepared pulp by vacuum molding, drying the molded box and cover, compressing walls of the box and of the cover in a die casting machine to consolidate them and give them enhanced structural strength, and painting the box and the cover so that the coffin has beautified outer surfaces. Dies for compressing the walls of the box and the cover may be provided with patterns so as to form raised or depressed patterns on outer wall surfaces of the coffin.

A paper coffin made in accordance with the method of the present invention has the same strengthened structure and beautiful appearance as that of conventional coffins made of a whole piece of solid wood material.

Another object of the present invention is to provide a method of manufacturing paper coffin by using pulp prepared from waste and recycled paper, so that the manufacture of paper coffins is more economical without endangering our living environment.

DETAILED DESCRIPTION OF THE PREFRRED EMBODIMENTS

Figure 1:
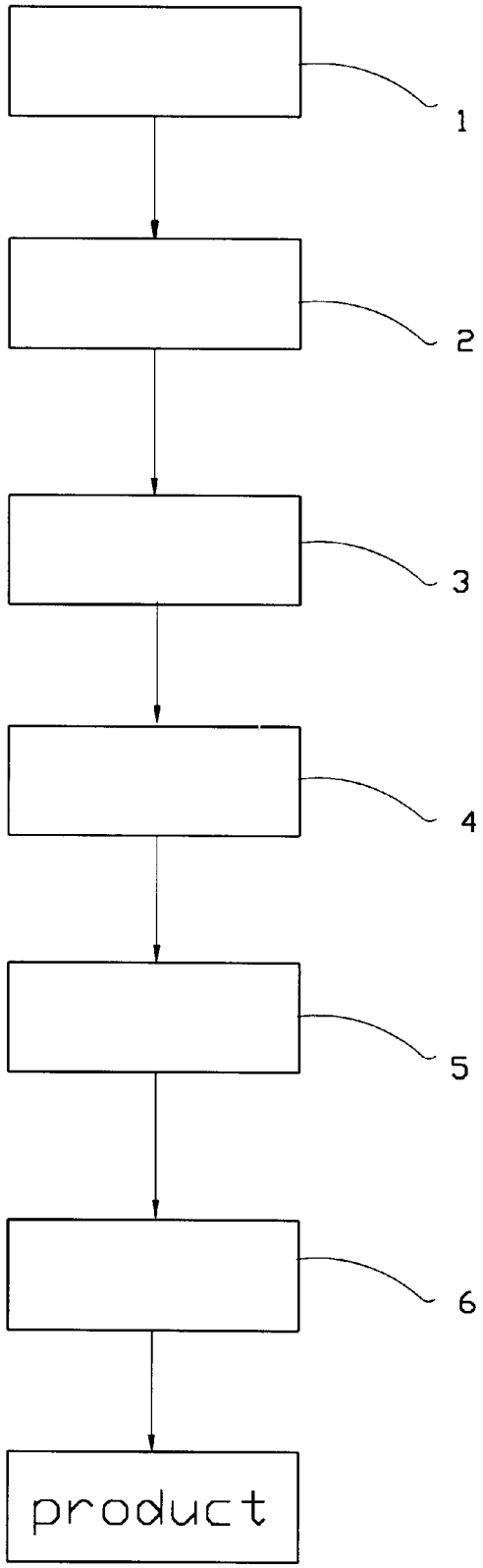
FIG. 1 is a flowchart of the method of the present invention.

The present invention relates to a method of manufacturing a paper coffin 10 for use in cremation. Please refer to FIG. 1 that is a flowchart of the method of the present invention and FIG. 2 that is a perspective of a paper coffin 10 made from the method of the present invention. The method includes following steps:

(1) Preparing papermaking pulp from waste and recycled paper by thrashing, hydrolyzing or dissolving, and grinding the waste/recycled paper, and then adding additives into the prepared pulp;

(2) Forming a box 11 and a cover 12 from the prepared pulp by vacuum molding. The box 11 forms a main body of the coffin;

(3) Drying the molded box 11 and cover 12;

(4) Compressing walls of the box 11 and of the cover 12 in a die casting machine so that they are respectively consolidated and/or embossed at outer surfaces. This step allows the box 11 to be integrally formed and have solid walls that provide enhanced structural strength;

(5) Giving the box 11 and the cover 12 necessary surface treatment, such as painting, so that the coffin has beautified outer surfaces; and (6) Providing necessary interior decoration (not shown) to the box 11.

The box 11 and the cover 12 produced from the above steps together form a finished product of paper coffin 10 for use in a cremation.

In the step 4 of compressing, consolidating, and embossing walls of the box 11 and of the cover 12, a die used for this purpose may be provided in advance with pattern or patterns, in order to form corresponding pattern or patterns raised from or depressed into inner and outer wall surfaces of the box 11. Embossed pattern or patterns make the paper coffin 10 look better in its appearance.

The box 11 and the cover 12 usually have considerably smooth wall surfaces from step 4. The step 5 of painting the wall surfaces of the box 11 and of the cover 12 enables the wall surfaces to be as smooth and beautiful as that of conventional wooden and metal coffins.

Figure 2:
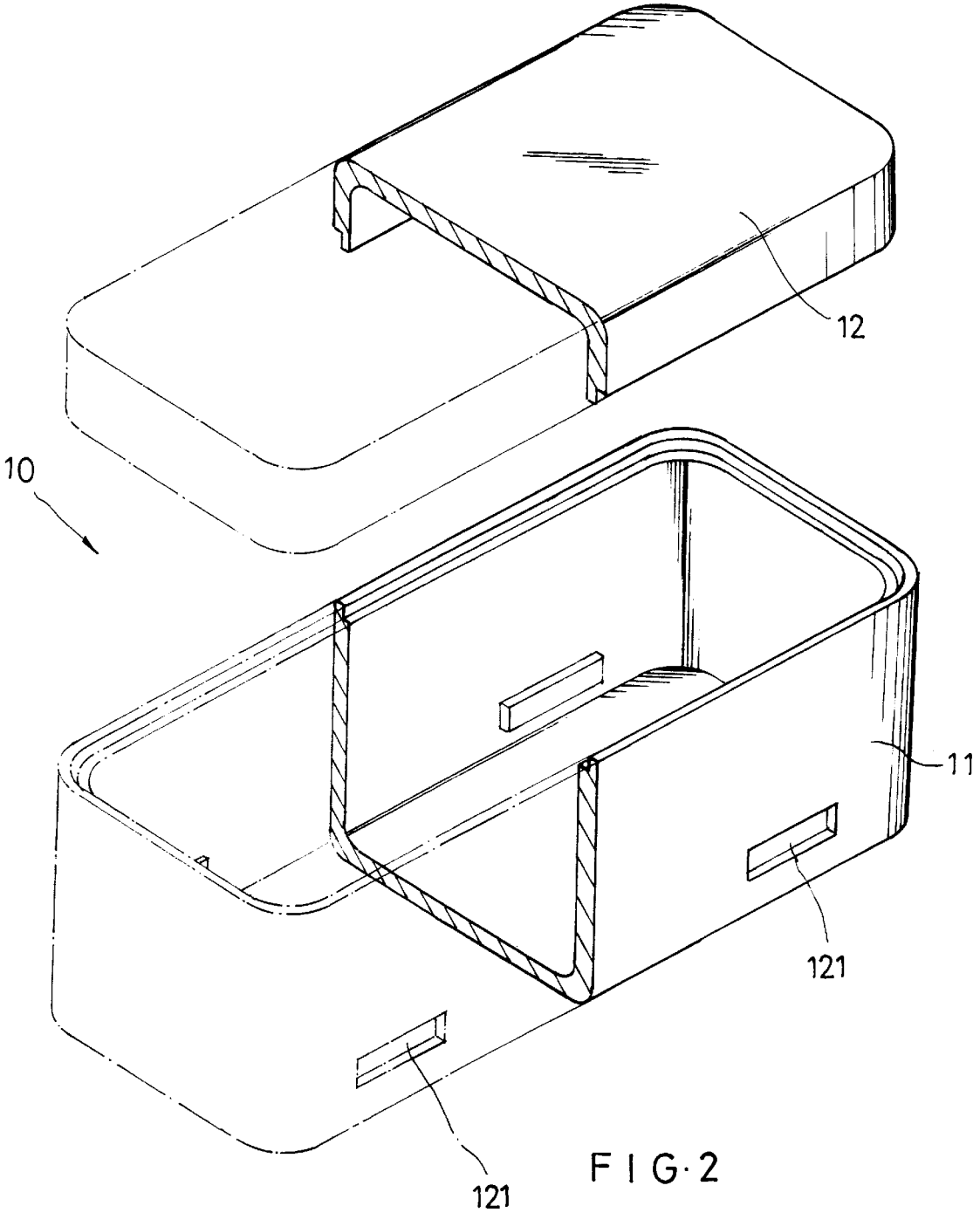
FIG. 2 is a perspective of an embodiment of paper coffin made according to the method of the present invention with a part thereof being cut away to show the structure thereof.

The box 11 and the cover 12 formedfrom pulp by vacuum molding as taught by the present invention have a minimum wall thickness of 4 cm before being compressed and consolidated, and a minimum wall thickness of 2.5 cm after being compressed and consolidated. Since the box 11 is integrally formed and its wall thickness is no less than 2.5 cm, it provides good and sufficient strength for carrying a corpse. The paper coffin 10 made according to the method of the present invention, as shown in FIG. 2, is provided at two outer side wall surfaces of the box 11 with horizontally extended recesses 13 by means of, for example, particularly compressing those portions, to facilitate lifting of the paper coffin 10 at these positions.

The compressed and consolidated walls of the box 11 and the cover 12 have high density and hardness that is almost the same as that of wood. Moreover, since the box 11 is integrally formed, it functions just like a coffin formed from a whole piece of solid wood. In other words, the paper coffin 10 has structural strength and appearance both extremely close to that of a coffin made of solid wood.

The pulp used in the present invention for making the paper coffin 10 can be prepared from waste paper and recycled paper that is not only environmental friendly but also easily available at low cost to allow reduced manufacturing cost.

What is claimed is:

1. A method of manufacturing paper coffin for use in cremation, comprising the following steps:

a. preparing a papermaking pulp from a waste or recycled paper by thrashing, hydrolyzing or dissolving, and grinding the waste/recycled paper, and then adding additives into the papermaking pulp;

b. forming a box and a cover from the papermaking pulp by vacuum molding, said box forming a main body of said coffin;

c. drying said molded box and said cover;

d. compressing walls of said box and of said cover in a die casting machine so that they are respectively consolidated, to thus cause said box to be integrally formed and have solid walls;

e. providing a surface treatment to said box and said cover, so that said coffin has beautified outer surfaces; and f. providing an interior decoration to said box.

2. A method of manufacturing paper coffin for use in cremation as claimed in claim 1, wherein the step of compressing and consolidating walls of said box and said cover further comprises a step of providing pattern or patterns in dies for compressing said box and said cover so as to create corresponding pattern or patterns raised from and/or depressed into inner and outer wall surfaces of said box and of said cover.

3. A method of manufacturing paper coffin for use in cremation as claimed in claim 1, wherein said surface treatment is paining.

* * * * *